US012092097B2

(12) United States Patent
Fu et al.

(10) Patent No.: US 12,092,097 B2
(45) Date of Patent: Sep. 17, 2024

(54) FRACTURING APPARATUS AND VIBRATION REDUCTION METHOD THEREOF

(71) Applicant: YANTAI JEREH PETROLEUM EQUIPMENT & TECHNOLOGIES CO., LTD., Shandong (CN)

(72) Inventors: Shanwu Fu, Shandong (CN); Liang Li, Shandong (CN); Ruijie Du, Shandong (CN); Jifeng Zhong, Shandong (CN); Sheng Chang, Shandong (CN); Jian Zhang, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 26 days.

(21) Appl. No.: 17/693,218

(22) Filed: Mar. 11, 2022

(65) Prior Publication Data

US 2023/0047033 A1 Feb. 16, 2023

(30) Foreign Application Priority Data

Aug. 12, 2021 (CN) ..... 202110924004.9
Aug. 12, 2021 (CN) ..... 202121882008.7

(51) Int. Cl.
*F04B 49/20* (2006.01)
*E21B 43/26* (2006.01)
(Continued)

(52) U.S. Cl.
CPC ..... *F04B 49/20* (2013.01); *E21B 43/2607* (2020.05); *F04B 15/02* (2013.01);
(Continued)

(58) Field of Classification Search
CPC ..... F04B 49/20; F04B 49/10; F04B 49/065; F04B 49/00; F04B 15/00; F04B 51/00;
(Continued)

(56) References Cited

U.S. PATENT DOCUMENTS 11,047,379 B1 * 6/2021 Li ..... F04B 51/00
2013/0071256 A1 3/2013 Kent
(Continued)

FOREIGN PATENT DOCUMENTS

CN 103104451 A 5/2013
CN 103883494 B 1/2016
(Continued)

OTHER PUBLICATIONS

Written Opinion and International Search Report for PCT Application No. PCT/CN2021/120712 mailed on May 18, 2022.

*Primary Examiner* — Charles G Freay
(74) *Attorney, Agent, or Firm* — Sheppard Mullin Richter & Hampton LLP

(57) ABSTRACT

A fracturing apparatus and a vibration reduction method thereof. The fracturing apparatus includes at least one fracturing unit and a processing device, the fracturing unit includes: a plunger pump; a low-pressure liquid inlet manifold; a high-pressure discharge manifold; a pressure detection device, configured to detect a pressure value of the low-pressure fluid in the low-pressure liquid inlet manifold; and a vibration detection device, configured to detect vibration intensity of the plunger pump, the processing device is respectively communicated with the plunger pump, the pressure detection device and the vibration detection device, and is configured to control the plunger pump according to the vibration intensity detected by the vibration detection device and the pressure value detected by the pressure
(Continued)

detection device. The fracturing apparatus can improve the displacement stability and serve life of the plunger pump.

20 Claims, 5 Drawing Sheets

(51) Int. Cl.

| | |
|---|---|
| ***F04B 15/02*** | (2006.01) |
| ***F04B 49/06*** | (2006.01) |
| ***F04B 49/10*** | (2006.01) |
| *F04B 17/06* | (2006.01) |
| *F04B 49/00* | (2006.01) |
| *F04B 51/00* | (2006.01) |

(52) U.S. Cl.
CPC ..... *F04B 49/065* (2013.01); *F04B 49/10* (2013.01); *F04B 17/06* (2013.01); *F04B 49/00* (2013.01); *F04B 51/00* (2013.01); *F04B 2201/0802* (2013.01); *F04B 2205/01* (2013.01)

(58) Field of Classification Search
CPC ..... F04B 2201/0802; F04B 2203/01; E21B 43/2607
See application file for complete search history.

(56) References Cited

U.S. PATENT DOCUMENTS

| | | | | |
|---|---|---|---|---|
| 2018/0223640 | A1 | 8/2018 | Keihany et al. | |
| 2020/0309113 | A1* | 10/2020 | Hunter ..... | F04B 49/06 |
| 2023/0332592 | A1* | 10/2023 | He ..... | F04B 49/22 |

FOREIGN PATENT DOCUMENTS

| | | | |
|---|---|---|---|
| CN | 204941508 | U | 1/2016 |
| CN | 205503376 | U | 8/2016 |
| CN | 205936563 | U | 2/2017 |
| CN | 205937080 | U | 2/2017 |
| CN | 206723028 | U | 12/2017 |
| CN | 207030807 | U | 2/2018 |
| CN | 209654209 | U | 11/2019 |
| CN | 209977150 | U | 1/2020 |
| CN | 111077281 | A | 4/2020 |
| CN | 111219326 | A | 6/2020 |
| CN | 111502974 | A | 8/2020 |
| CN | 211692342 | U | 10/2020 |
| CN | 112983381 | A | 6/2021 |
| CN | 215409135 | U | 1/2022 |

* cited by examiner

FRACTURING APPARATUS AND VIBRATION REDUCTION METHOD THEREOF

CROSS REFERENCES TO RELATED APPLICATIONS

The present application claims the priority of the Chinese patent application No. 202110924004.9 filed on Aug. 12, 2021, and the Chinese patent application No. 202121882008.7 filed on Aug. 12, 2021, for all purposes, the disclosure of which is incorporated herein by reference in its entirety as part of the present application.

TECHNICAL FIELD

The embodiments of the present disclosure relate to a fracturing apparatus and a vibration reduction method thereof.

BACKGROUND

In the field of oil and natural gas exploitation, fracturing technology is a method of using high-pressure fracturing fluid to form cracks in oil and gas reservoirs. The fracturing technology improves a flow environment of oil and gas underground by causing cracks in oil and gas reservoirs, so that output of oil wells can be increased, thus the fracturing technology is widely used in conventional and unconventional oil and gas exploitation, offshore and onshore oil and gas resource development.

A plunger pump is a device that uses a reciprocating motion of a plunger in a cylinder to pressurize liquid. The plunger pump has advantages of high rated pressure, compact structure and high efficiency, thus the plunger pump is used in the fracturing technology.

SUMMARY

Embodiments of the present disclosure provide a fracturing apparatus and a vibration reduction method thereof. The fracturing apparatus can reduce the vibration of the plunger pump through the pressure detection device, the vibration detection device and the processing device, so that a displacement stability and a service life of the plunger pump can be improved.

At least one embodiment of the present disclosure provides a fracturing apparatus, which includes at least one fracturing unit and a processing device, the fracturing unit includes: a plunger pump; a low-pressure liquid inlet manifold, connected with the plunger pump and configured to provide low-pressure fluid to the plunger pump; a high-pressure discharge manifold, connected with the plunger pump, and the plunger pump being configured to pressurize the low-pressure fluid and discharge it through the high-pressure discharge manifold; a pressure detection device, configured to detect a pressure value of the low-pressure fluid in the low-pressure liquid inlet manifold; and a vibration detection device, configured to detect vibration intensity of the plunger pump, the processing device is respectively communicated with the plunger pump, the pressure detection device and the vibration detection device, and is configured to control the plunger pump according to the vibration intensity detected by the vibration detection device and the pressure value detected by the pressure detection device.

For example, in the fracturing apparatus provided by an embodiment of the present disclosure, the processing device is configured to compare the vibration intensity detected by the vibration detection device with a preset vibration intensity, compare the pressure value detected by the pressure detection device with a preset pressure range, and control the plunger pump and reduce a number of strokes of the plunger pump upon the vibration intensity being greater than the preset vibration intensity and the pressure value being within the preset pressure range.

For example, in the fracturing apparatus provided by an embodiment of the present disclosure, the plunger pump includes a base, a power end and a hydraulic end, the power end and the hydraulic end are arranged on the base, and the power end is connected with the hydraulic end; and the vibration detection device includes a first vibration sensor, a second vibration sensor, and a third vibration sensor, the first vibration sensor is located on the base and is configured to detect vibration intensity of the base, the second vibration sensor is located on the power end and is configured to detect vibration intensity of the power end, and the third vibration sensor is located on the hydraulic end and is configured to detect vibration intensity of the hydraulic end.

For example, in the fracturing apparatus provided by an embodiment of the present disclosure, the fracturing unit further includes: a prime mover, including a power take-off shaft; a reduction gearbox, including an input gear shaft; and a fixing component, the plunger pump includes a power input shaft, the power input shaft is connected with the reduction gearbox, the input gear shaft is connected with the power take-off shaft, one end of the fixing component is fixedly connected with the plunger pump, and the other end of the fixing component is fixedly connected with the reduction gearbox.

For example, in the fracturing apparatus provided by an embodiment of the present disclosure, a connection position of the fixing component and the reduction gearbox is located on a side of the input gear shaft away from the power input shaft.

For example, in the fracturing apparatus provided by an embodiment of the present disclosure, the fixing component includes: a first pull rod, a first end of the first pull rod is fixedly connected with the plunger pump, and a second end of the first pull rod is fixedly connected with the reduction gearbox; and a second pull rod, one end of the second pull rod is fixedly connected with the first end or the second end of the first pull rod, the other end of the second pull rod is fixedly connected with the plunger pump or the reduction gearbox.

For example, in the fracturing apparatus provided by an embodiment of the present disclosure, the fracturing unit further includes: a flexible coupling or a flexible drive shaft, one end of the flexible coupling or one end of the flexible drive shaft is connected with the input gear shaft, and the other end of the flexible coupling or the other end of the flexible drive shaft is connected with the power take-off shaft.

For example, in the fracturing apparatus provided by an embodiment of the present disclosure, the fracturing unit further includes: a silicone oil damper, sleeved on at least one of the input gear shaft and the power take-off shaft.

For example, in the fracturing apparatus provided by an embodiment of the present disclosure, the fracturing unit further includes: an equipment carrier; and an elastic vibration damping device, the plunger pump is fixed on the equipment carrier, one end of the elastic vibration damping device is connected with the high-pressure discharge manifold, and the other end of the elastic vibration damping device is connected with the equipment carrier or the plunger pump.

For example, in the fracturing apparatus provided by an embodiment of the present disclosure, the elastic vibration damping device includes at least one of a steel wire vibration damper and a rubber vibration damping pad.

For example, in the fracturing apparatus provided by an embodiment of the present disclosure, the high-pressure discharge manifold includes: a first discharge pipe; a second discharge pipe; and a high-pressure movable elbow, respectively connected with the first discharge pipe and the second discharge pipe.

For example, in the fracturing apparatus provided by an embodiment of the present disclosure, the fracturing unit further includes: a low-pressure groove joint, located at a fluid inlet of the low-pressure liquid inlet manifold; and an energy storage vibration damping module, located on the low-pressure liquid inlet pipe manifold.

For example, in the fracturing apparatus provided by an embodiment of the present disclosure, the low-pressure liquid inlet manifold includes: an annular inlet manifold, including an upper liquid inlet pipe, a lower liquid inlet pipe, a first connection pipe and a second connection pipe, the upper liquid inlet pipe and the lower liquid inlet pipe are arranged opposite to each other, the first connection pipe is respectively connected with a first end of the upper liquid inlet pipe and a first end of the lower liquid inlet pipe, and the second connection pipe is respectively connected with a second end of the upper liquid inlet pipe and a second end of the lower liquid inlet pipe; a liquid inlet connector, located on the upper liquid inlet pipe and configured to be connected with the plunger pump; a liquid supply pipe, communicated with the first end of the lower liquid inlet pipe; and an intermediate connection pipe, one end of the intermediate connection pipe is connected with a middle portion of the upper liquid inlet pipe, the other end of the intermediate connection pipe is communicated with a middle portion of the lower liquid inlet pipe.

For example, in the fracturing apparatus provided by an embodiment of the present disclosure, a first distance between the first end of the upper liquid inlet pipe and the first end of the lower liquid inlet pipe is greater than a second distance between the second end of the upper liquid inlet pipe and the second end of the lower liquid inlet pipe.

For example, in the fracturing apparatus provided by an embodiment of the present disclosure, the low-pressure liquid inlet manifold includes: a drain port, located on the upper liquid inlet pipe; and a check port, located on the lower liquid inlet pipe.

For example, in the fracturing apparatus provided by an embodiment of the present disclosure, the low-pressure liquid inlet manifold includes: a main liquid inlet pipe; a liquid supply pipe, connected with a first end of the main liquid inlet pipe; a curved liquid feeding pipe, one end of the curved liquid feeding pipe is connected with a second end of the main liquid inlet pipe, the other end of the curved liquid feeding pipe is provided with a liquid inlet connector, the liquid inlet connector is configured to be connected with the plunger pump; and at least one liquid feeding pipe, one end of each of the at least one liquid feeding pipe is communicated with the main liquid inlet pipe, the other end of each of the at least one liquid feeding pipe is provided with a liquid inlet connector, and the liquid inlet connector is configured to be connected with the plunger pump, a diameter of the first end of the main liquid inlet pipe is larger than a diameter of the second end of the main liquid inlet pipe, in a direction from the first end of the main liquid inlet pipe to the second end of the main liquid inlet pipe, the at least one liquid feeding pipe and the curved liquid feeding pipe are arranged in sequence, and the lengths of the at least one liquid feeding pipe and the curved liquid feeding pipe gradually decrease.

For example, in the fracturing apparatus provided by an embodiment of the present disclosure, the at least one fracturing unit includes a plurality of the fracturing units, the processing device is respectively communicated with a plurality of the plunger pumps, a plurality of the pressure detection devices, and a plurality of the vibration detection devices in the plurality of the fracturing units.

At least one embodiment of the present disclosure further provides the abovementioned vibration reduction method of the fracturing apparatus, which includes: acquiring a pressure value of the low-pressure fluid in the low-pressure liquid inlet manifold through the pressure detection device; acquiring vibration intensity of the plunger pump through the vibration detection device; comparing the vibration intensity detected by the vibration detection device with a preset vibration intensity, comparing the pressure value detected by the pressure detection device with a preset pressure range; and controlling the plunger pump and reducing a number of strokes of the plunger pump upon the vibration intensity being greater than the preset vibration intensity and the pressure value being within the preset pressure range.

For example, in the vibration reduction method of the fracturing apparatus provided by an embodiment of the present disclosure, the at least one fracturing unit of the fracturing apparatus includes a plurality of the fracturing units, the processing device is respectively communicated with a plurality of the plunger pumps, a plurality of the pressure detection devices, and a plurality of the vibration detection devices in the plurality of the fracturing units, and the vibration reduction method further includes: acquiring vibration intensity of the plunger pump of each of the plurality of the fracturing units and a pressure value of the low-pressure fluid in the low-pressure liquid inlet manifold of each of the fracturing units; comparing the vibration intensity of the plunger pump of each of the plurality of fracturing units with the preset vibration intensity, comparing the pressure value of the low-pressure fluid in the low-pressure liquid inlet manifold of each of the plurality of fracturing units with a preset pressure range; and reducing a number of strokes of the plunger pump of a fracturing unit whose vibration intensity is greater than the preset vibration intensity and pressure value is within the preset pressure range among the plurality of the fracturing units, and increasing a number of strokes of the plunger pumps of other fracturing units among the plurality of the fracturing units.

For example, the vibration reduction method of the fracturing apparatus provided by an embodiment of the present disclosure further includes: increasing pressure of the low-pressure fluid in the low-pressure liquid inlet manifold upon the vibration intensity being greater than the preset vibration intensity and the pressure value being less than the preset pressure range; and reducing the pressure of the low-pressure fluid in the low-pressure liquid inlet manifold upon the vibration intensity being greater than the preset vibration intensity and the pressure value being greater than the preset pressure range.

BRIEF DESCRIPTION OF THE DRAWINGS

In order to clearly illustrate the technical solution of the embodiments of the present disclosure, the drawings of the embodiments will be briefly described. It is apparent that the described drawings are only related to some embodiments of the present disclosure and thus are not limitative of the present disclosure.

DETAILED DESCRIPTION

Figure 1:
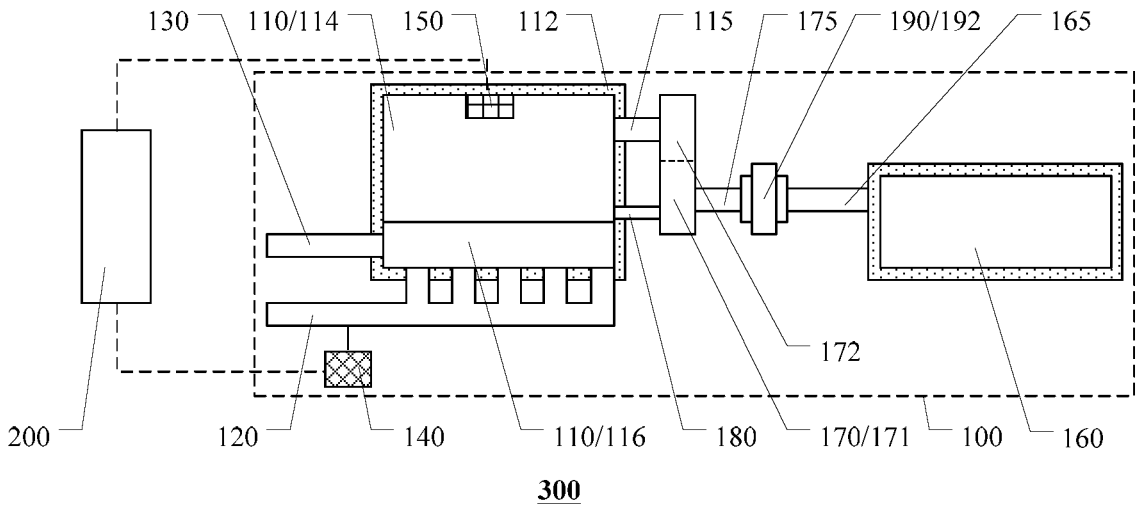
FIG. 1 is a schematic diagram of a fracturing apparatus provided by an embodiment of the present disclosure.

In order to make objects, technical details and advantages of embodiments of the present disclosure clear, the technical solutions of the embodiments will be described in a clearly and fully understandable way in connection with the related drawings. It is apparent that the described embodiments are just a part but not all of the embodiments of the present disclosure. Based on the described embodiments herein, those skilled in the art can obtain, without any inventive work, other embodiment(s) which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and claims of the present disclosure, are not intended to indicate any sequence, amount or importance, but distinguish various components. The terms "includes," "including," "includes," "including," etc., are intended to specify that the elements or the objects stated before these terms encompass the elements or the objects listed after these terms as well as equivalents thereof, but do not exclude other elements or objects. The phrases "connect", "connected", etc., are not intended to define a physical connection or a mechanical connection, but may include an electrical connection which is direct or indirect.

A common fracturing apparatus includes an equipment carrier, a plunger pump, a prime mover, a low-pressure liquid inlet manifold and a high-pressure discharge manifold. The plunger pump is arranged on the equipment carrier, and the plunger pump includes a power end and a hydraulic end; the prime mover is connected with the power end of the plunger pump, and provides power to the power end; the power end converts the power provided by the prime mover into a reciprocating motion of the plunger; the low-pressure liquid inlet manifold is connected with the hydraulic end of the plunger pump, and provides low-pressure fracturing fluid to the hydraulic end; the hydraulic end can use the reciprocating motion of the plunger pump to pressurize low-pressure fluid to form high-pressure fracturing fluid; the high-pressure discharge manifold is connected with the hydraulic end of the plunger pump, and is used to discharge the high-pressure fracturing fluid. In this way, the fracturing apparatus can provide the high-pressure fracturing fluid, so that the high-pressure fracturing fluid can be used in fracturing operations. It should be noted that, the above-mentioned prime mover can be a device that provides power, such as a diesel engine, an electric motor, or a turbine engine. In addition, because the prime mover (especially the electric motor and the turbine engine) has a high speed, a reduction gearbox is needed to be installed between the plunger pump and the prime mover, so that the reduction gearbox is used to decelerate the power output of the prime mover, to match the plunger pump.

During a working process of the fracturing apparatus, the plunger pump will vibrate due to various factors such as flow of fracturing fluid in the low-pressure liquid inlet manifold and the high-pressure liquid inlet manifold, the reciprocating motion of the plunger in the power end, and a high-speed rotation of a take-off shaft of the prime mover; and these vibrations will have a greater impact on the plunger pump, for example, a displacement of the plunger pump will fluctuate, components of the plunger pump will be damaged, and a service life of the plunger pump will be reduced, and these vibrations will even cause abnormal shutdown of the plunger pump and equipment damage.

For example, due to layout restrictions, a power input shaft of the plunger pump and a power take-off shaft of the prime mover are not completely coaxial or concentric, or a transmission mechanism between the power input shaft of the plunger pump and the power take-off shaft of the prime mover has poor component accuracy, in this case, the transmission mechanism will inevitably bring about a deviation of a center of mass of a moment of inertia under high-speed rotation, and large vibrations are produced. In addition, an intermittent operation of each plunger in the plunger pump causes a pressure of the fracturing fluid to increase sharply, which generates a part of liquid impact on the low-pressure liquid inlet manifold and the high-pressure discharge manifold, so that greater vibrations are generated.

On the other hand, during the working process of the fracturing apparatus, because the plunger pump is usually only fixedly connected with an output part of a gearbox, the gearbox is easy to form a cantilever structure; in this case, in the case where the fracturing apparatus is working, the vibration of the plunger pump and the vibration of the gearbox will produce a non-synchronization phenomenon, so that, on the one hand, the non-synchronization phenomenon will make the vibration of the plunger pump more severe, and, on the other hand, the non-synchronization phenomenon will cause shaft damage to the plunger pump and the gearbox.

In this regard, embodiments of the present disclosure provide a fracturing apparatus, which includes at least one fracturing unit and a processing device; the fracturing unit includes a plunger pump, a low-pressure liquid inlet manifold, a high-pressure discharge manifold, a pressure detection device and a vibration detection device; the low-pressure liquid inlet manifold is connected with the plunger pump and is configured to provide low-pressure fluid to the plunger pump; the high-pressure discharge manifold is connected with the plunger pump, the plunger pump is configured to pressurize the low pressure fluid and discharge it through the high-pressure discharge manifold; the pressure detection device is configured to detect a pressure value of the low-pressure fluid in the low-pressure liquid inlet manifold; the vibration detection device is configured to detect vibration intensity of the plunger pump; the processing device is respectively communicated with the plunger pump, the pressure detection device and the vibration detection device, and is configured to control the plunger pump according to the vibration intensity detected by the vibration detection device and the pressure value detected by the pressure detection device. The fracturing apparatus can reduce the vibration of the plunger pump through the pressure detection device, the vibration detection device and the processing device, so that a displacement stability and a service life of the plunger pump can be improved.

Embodiments of the present disclosure further provide a vibration reduction method of the fracturing apparatus, which includes: acquiring a pressure value of the low-pressure fluid in the low-pressure liquid inlet manifold through the pressure detection device; acquiring vibration intensity of the plunger pump through the vibration detection device; comparing the vibration intensity detected by the vibration detection device with a preset vibration intensity, comparing the pressure value detected by the pressure detection device with a preset pressure range; and controlling the plunger pump and reducing a number of strokes of the plunger pump upon the vibration intensity being greater than the preset vibration intensity and the pressure value being within the preset pressure range. In this way, the vibration reduction method of the fracturing apparatus can reduce the vibration of the plunger pump, so that the displacement stability and the service life of the plunger pump can be improved.

Hereinafter, the fracturing apparatus and the vibration reduction method of the fracturing apparatus provided by the embodiments of the present disclosure will be described in detail with reference to the accompanying drawings.

Figure 2:
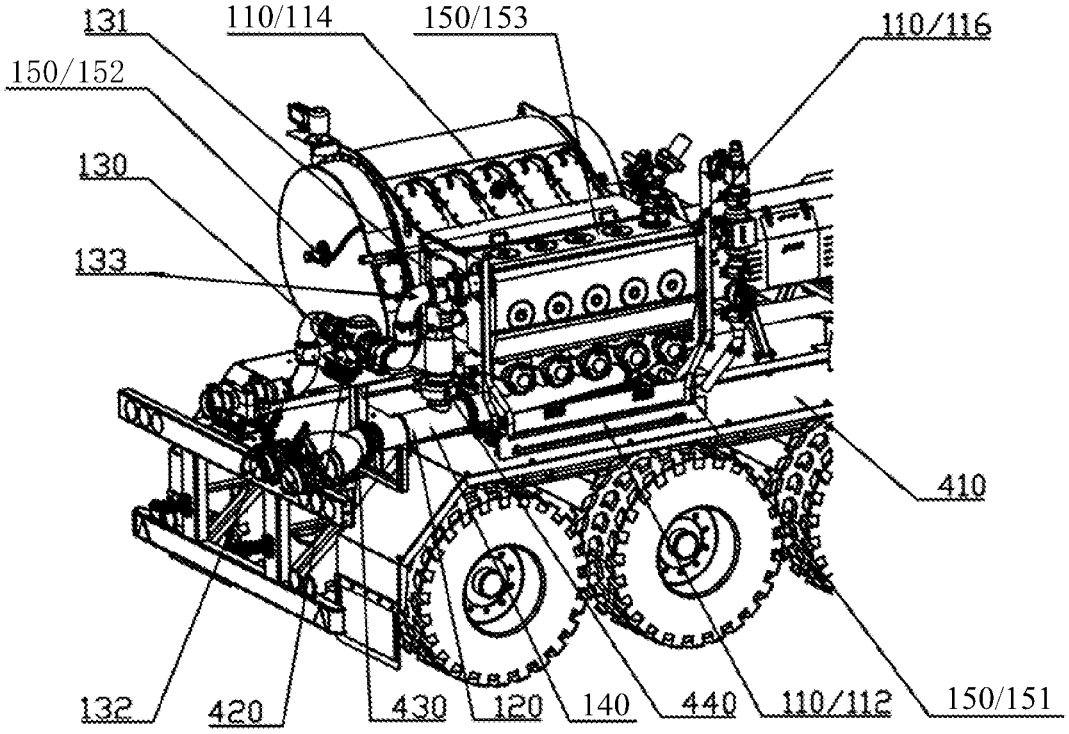
FIG. 2 is a partial schematic diagram of a fracturing unit provided by an embodiment of the present disclosure.

FIG. 1 is a schematic diagram of a fracturing apparatus provided by an embodiment of the present disclosure; FIG. 2 is a partial schematic diagram of a fracturing unit provided by an embodiment of the present disclosure. As illustrated by FIG. 1, the fracturing apparatus 300 includes at least one fracturing unit 100 and a processing device 200; FIG. 1 shows one fracturing unit 100; the fracturing unit 100 includes a plunger pump 110, a low-pressure liquid inlet manifold 120, a high-pressure discharge manifold 130, a pressure detection device 140, and a vibration detection device 150. It should be noted that, FIG. 1 only shows one fracturing unit, but the fracturing apparatus provided by the embodiments of the present disclosure may include a plurality of fracturing units; the plurality of fracturing units can form a fracturing unit group, so that a higher displacement can be provided. In addition, the fracturing unit may be a fracturing truck or a fracturing skid.

As illustrated by FIG. 1 and FIG. 2, the low-pressure liquid inlet manifold 120 is connected with the plunger pump 110 and is configured to provide low-pressure fluid, for example, fracturing fluid or sand mixing fluid, to the plunger pump 110; the high-pressure discharge manifold 130 is connected with the plunger pump 110, and the plunger pump 110 is configured to pressurize the low-pressure fluid and discharge it through the high-pressure discharge manifold 130; the pressure detection device 140 is configured to detect a pressure value of the low-pressure fluid in the low-pressure liquid inlet manifold 120; the vibration detection device 150 is configured to detect vibration intensity of the plunger pump 110; the processing device 200 is respectively communicated with the plunger pump 110, the pressure detection device 140 and the vibration detection device 150, and is configured to control the plunger pump 110 according to the vibration intensity detected by the vibration detection device 150 and the pressure value detected by the pressure detection device 140. It should be noted that, the above-mentioned vibration intensity indicates an intensity of vibration, for example, a maximum value, an average value, or a root mean square value of parameters (such as displacement, velocity, and acceleration) that characterize a vibration level can be used.

In the fracturing apparatus provided by the embodiments of the present disclosure, the vibration detection device can detect the vibration intensity of the plunger pump, so that the vibration of the plunger pump can be monitored, and the pressure detection device can detect the pressure value of the low-pressure fluid in the low-pressure liquid inlet manifold, thus the pressure value of the low-pressure fluid in the low-pressure liquid inlet manifold can be monitored; the processing device is respectively communicated with the above-mentioned vibration detection device and the above-mentioned pressure detection device, so that the plunger pump can be controlled according to the vibration intensity detected by the vibration detection device and the pressure value detected by the pressure detection device, for example, changing a number of strokes of the plunger pump, thus the vibration intensity of the plunger pump is reduced, and the service life of the plunger pump can be further increased.

In some examples, the above-mentioned "communicated" includes a communication connection through a wired connection (such as a wire, an optical fiber, etc.), and also includes a communication connection through a wireless connection (such as a WiFi, a mobile network).

In some examples, the processing device described above may include a storage medium and a processor; the storage medium is used for storing a computer program; the processor is use for executing that compute program in the storage medium to realize controlling the plunger pump according to the vibration intensity detected by the vibration detection device and the pressure value detected by the pressure detection device.

For example, the storage medium mentioned above can be volatile memory and/or nonvolatile memory. The volatile memory may include, for example, random access memory (RAM) and/or cache. The nonvolatile memory may include, for example, a read-only memory (ROM), a hard disk, a flash memory, etc.

For example, the above-mentioned processor may be a central processing unit (CPU) or other forms of processing devices with data processing capability and/or instruction execution capability, for example, it may include a microprocessor, a programmable logic controller (PLC), etc.

In some examples, the above-mentioned processing device can be implemented in software to be executed by various types of processors. For example, an identified executable code module can include one or more physical or logical blocks of computer instructions, which can be constructed as objects, procedures or functions, for example. However, the executable codes of the identified modules do not need to be physically located together, but can include different instructions stored in different physics. In the case where these instructions are logically combined together, they constitute the module and achieve the specified purpose of the module.

Actually, the executable code module can be a single instruction or many instructions, and even can be distributed on many different code segments, among different programs, and across many memory devices. Similarly, the operation data can be identified within the module, and can be implemented in any suitable form and organized in any suitable type of data structure. The operation data can be collected as a single data set, or can be distributed in different locations (including different storage devices), and at least partially can only exist as electronic signals on the system or network.

In the case where the above-mentioned processing device can be realized by software, considering the level of existing hardware technology, the above-mentioned processing device that can be realized by software, without considering the cost, can be built by the technicians in the field with corresponding hardware circuits to realize the corresponding functions, including conventional VLSI circuits or gate arrays, existing semiconductors such as logic chips and transistors or other discrete components. The above-mentioned processing device can also be implemented with programmable hardware devices, such as field programmable gate arrays, programmable array logic, programmable logic devices, etc.

For example, in the case where the processing device is respectively connected with the plunger pump, the pressure detection device, and the vibration detection device in a wireless manner, and the processing device, the plunger pump, the pressure detection device and the vibration detection device may each include a wireless communication module.

In some examples, the processing device 200 is configured to compare the vibration intensity detected by the vibration detection device 150 with a preset vibration intensity, to compare the pressure value detected by the pressure detection device 140 with a preset pressure range, and to control the plunger pump 110 and to reduce the number of strokes of the plunger pump 110 upon the vibration intensity being greater than the preset vibration intensity and the pressure value being within the preset pressure range. In this way, in the case where the vibration intensity detected by the vibration detection device 150 is greater than the preset vibration intensity, the processing device 200 may first determine whether the pressure value detected by the pressure detection device 140 is within the preset pressure range, if the pressure detection device 140 detects that the pressure value is within the preset pressure range, the vibration of the plunger pump 110 can be reduced by reducing the number of strokes of the plunger pump 110.

In some examples, as illustrated by FIG. 1 and FIG. 2, the plunger pump 110 includes a base 112, a power end 114 and a hydraulic end 116, the power end 114 and the hydraulic end 116 are arranged on the base 112, the power end 114 is connected with the hydraulic end 116. The power end 114 and the hydraulic end 116 are fixed on the base 112, so that the vibration of the plunger pump is reduced.

For example, a shell of the power end and a shell of the hydraulic end can be fixedly connected by bolts and other connection methods. Of course, the embodiments of the present disclosure include but are not limited thereto, other connection methods can also be used to realize the fixed connection of the above-mentioned components.

For example, the power end may include a crankshaft connecting rod mechanism and a plunger, the crankshaft connecting rod mechanism can convert a rotary motion into a reciprocating motion of the plunger, at least a part of the plunger can extend into the hydraulic end, to pressurize low pressure fluid in the hydraulic end. It should be noted that, a structure and a working mode of the plunger pump are briefly described above, but the plunger pump provided by the embodiment of the present disclosure includes but is not limited to the above-mentioned structure and the above-mentioned working mode.

In some examples, as illustrated by FIG. 1 and FIG. 2, the vibration detection device 150 includes a first vibration sensor 151, a second vibration sensor 152, and a third vibration sensor 153; the first vibration sensor 151 is located on the base 112 and is configured to detect vibration intensity of the base 112, the second vibration sensor 152 is located on the power end 114 and is configured to detect vibration intensity of the power end 114, the third vibration sensor 153 is located on the hydraulic end 116 and is configured to detect vibration intensity of the hydraulic end 116. In this way, the vibration detection device can be provided with the first vibration sensor, the second vibration sensor and the third vibration sensor on the base, the power end, and the hydraulic end of the plunger pump to detect the vibration intensity at different positions of the plunger pump, so that the vibration of the plunger pump can be better monitored, which can also help diagnose the cause of vibration. Of course, the embodiments of the present disclosure include but are not limited thereto, the vibration detection device may also include more vibration sensors. For example, the vibration detection device may further include a vibration sensor arranged in the plunger pump. It should be noted that, in the case where the vibration detection device includes a plurality of vibration sensors, the vibration intensity detected by the vibration detection device may be a maximum value of the vibration intensity detected by the plurality of vibration sensors or an average value of the vibration intensity detected by the plurality of vibration sensors.

In some examples, as illustrated by FIG. 1 and FIG. 2, the fracturing unit 100 further includes an equipment carrier 410 and an elastic vibration damping device 420. The plunger pump 110 is fixed on the equipment carrier 410, one end of the elastic vibration damping device 420 is connected with the high-pressure discharge manifold 130, the other end of the elastic vibration damping device 420 is connected with the equipment carrier 410 or the plunger pump 110. In this way, the elastic vibration damping device can reduce vibration of the high-pressure discharge manifold, and can further avoid equipment damage caused by the vibration of the high-pressure discharge manifold. It should be noted that, in addition to the above-mentioned high-pressure discharge manifold, other parts in the fracturing unit having no damping ability can be damped by elastic vibration damping devices.

For example, in the case where the fracturing unit 100 is a fracturing vehicle, the above-mentioned equipment carrier 410 may be a vehicle body; in the case where the fracturing unit 100 is a fracturing skid, the above-mentioned equipment carrier 410 may be a skid.

In some examples, the above-mentioned elastic vibration damping device 420 includes at least one of a steel wire vibration damper and a rubber vibration damping pad. For example, the elastic vibration damping device 420 shown in FIG. 2 is a steel wire vibration damper.

In some examples, as illustrated by FIG. 2, the high-pressure discharge manifold 130 includes: a first discharge pipe 131, a second discharge pipe 132, and a high-pressure movable elbow 133, which is connected with the first discharge pipe 131 and the second discharge pipe 132 respectively. Because the high-pressure movable elbow can be adjusted at multiple angles, the high-pressure movable elbow arranged between the first discharge pipe and the second discharge pipe can absorb the vibration of the high-pressure discharge manifold, to reduce a transmission of the vibration.

In some examples, as illustrated by FIG. 2, the fracturing unit 100 also includes a low-pressure groove joint 430 and an energy storage vibration damping module 440; the low-pressure groove joint 430 is located at a fluid inlet of the low-pressure liquid inlet manifold 120; the energy storage vibration damping module 440 is located on the low-pressure liquid inlet manifold 120. The low-pressure groove joint has advantages of quick installation, simple and economical, and can also absorb a length displacement of the low pressure liquid inlet manifold due to vibration, so that the low-pressure groove joint plays a role of vibration reduction; the energy storage vibration damping module can use a working principle of energy storage and energy release of a accumulator, to absorb fluctuations of the fluid in the low-pressure liquid inlet manifold, at the same time, the energy storage vibration damping module can also make up for the shortcomings of insufficient instantaneous fluid pressure in the low-pressure liquid inlet manifold, so that the vibration can be reduced.

In some examples, as illustrated by FIG. 1, the fracturing unit 100 further includes a prime mover 160, a reduction gearbox 170 and a fixing component 180; the prime mover 160 includes a power take-off shaft 165; the reduction gearbox 170 includes an input gear shaft 175. The plunger pump 110 includes a power input shaft 115, the power input shaft 115 is connected with the reduction gearbox 170, the input gear shaft 175 is connected with the power take-off shaft 165, one end of the fixing component 180 is fixedly connected with the plunger pump 110, the other end of the fixing component 180 is fixedly connected with the reduction gearbox 170. In the fracturing apparatus, in the case where the reduction gearbox is only partially fixedly connected with the plunger pump to form a cantilever structure, because one end of the fixing component is fixedly connected with the plunger pump, and the other end of the fixing component is fixedly connected with the reduction gearbox, fixation and support between the plunger pump and the reduction gearbox can be increased, so that the vibration of the plunger pump and the vibration of the reduction gearbox can be reduced; on the other hand, the plunger pump is fixedly connected with the reduction gearbox through the above-mentioned fixing component, so that the vibration of the plunger pump can be synchronized with the vibration of the reduction gearbox, and shaft damage caused by unsynchronized vibration is reduced. In this way, the fracturing apparatus can reduce the vibration intensity, and can reduce a degree of asynchrony between the vibration of the plunger pump and the vibration of the reduction gearbox, so that the service life of the fracturing apparatus can be increased.

In some examples, in the case where a suction and discharge valve of the hydraulic end of the plunger pump fails, large fluctuations in the power of the prime mover will be detected; in this case, the failure of the suction and discharge valve on the hydraulic end can be judged by calculating power fluctuations of the prime mover.

In some examples, as illustrated by FIG. 1, the reduction gearbox 170 includes an input part 171 and an output part 172, the input part 171 includes an input gear shaft 175, the input gear shaft 175 is configured to connect with a power input, the output part 172 is connected with the power input shaft 115 of the plunger pump 110, one end of the fixing component 180 is fixedly connected with the plunger pump 110, and the other end of the fixing component 180 is fixedly connected with the reduction gearbox 170.

In some examples, as illustrated by FIG. 1, the plunger pump 110 includes a power end 114 and a hydraulic end 116, one end of the fixing component 180 is fixedly connected with the power end 114, the other end of the fixing component 180 is fixedly connected with the input part 171 of the reduction gearbox 170. In this way, one end of the fixing component is fixedly connected with the power end, and the other end of the fixing component is fixedly connected with an input part of the reduction gearbox, so that the plunger pump and the reduction gearbox can be better fixed, and thus the vibration of the plunger pump and the vibration of the reduction gearbox can be better reduced, and the vibration of the plunger pump and the vibration of the reduction gearbox is synchronized.

For example, the fixing component can be fixedly connected with the shell of the power end through bolts and other connection methods. Of course, the embodiments of the present disclosure include but are not limited thereto, other connection methods can also be used to realize the fixed connection of the above-mentioned components.

In some examples, as illustrated by FIG. 1 and FIG. 2, a connection position of the fixing component 180 and the input part 171 is located on a side of the input gear shaft 175 away from the output part 172. Because the part of the reduction gearbox 170 connected with the power input shaft 115 is relatively stable, and the part of the reduction gearbox 170 far away from the power input shaft 115 is in a suspended state, by arranging the connection position of the fixing component 180 and the reduction gearbox 170 on a side of the input gear shaft 175 away from the power input shaft 115, stability of the connection between the reduction gearbox and the plunger pump can be greatly improved, so that the vibration of the plunger pump and the reduction gearbox is effectively reduced.

Figure 3:
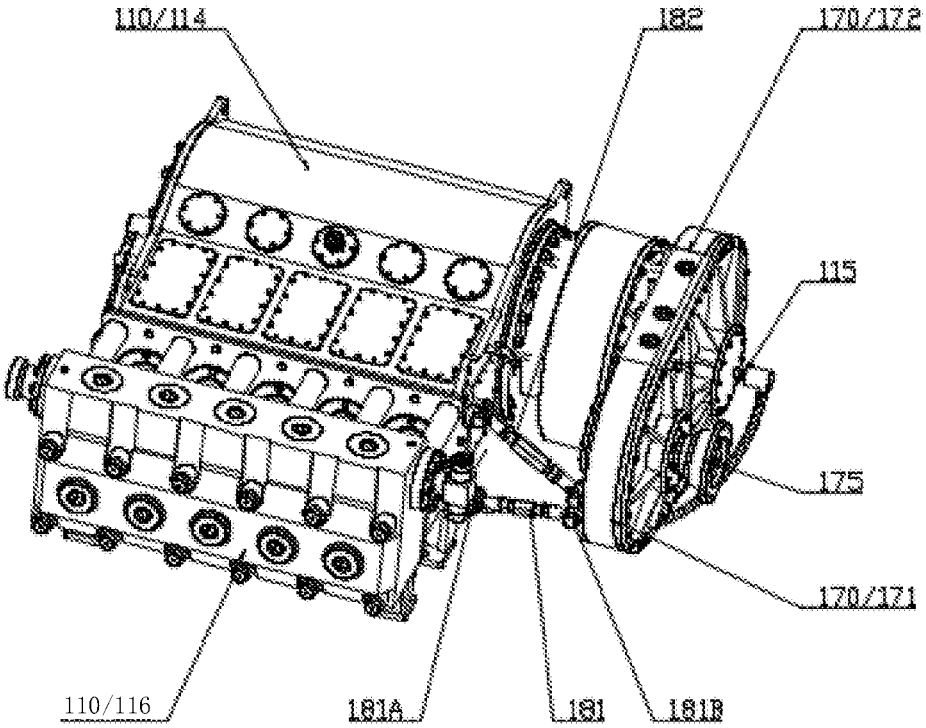
FIG. 3 is a layout schematic diagram of another fracturing apparatus provided by an embodiment of the present disclosure.

FIG. 3 is a layout schematic diagram of another fracturing apparatus provided by an embodiment of the present disclosure. As illustrated by FIG. 3, a connection position between the fixing component 180 and the reduction gearbox 170 is located on a side of the input gear shaft 175 away from the power input shaft 115. Because the part of the reduction gearbox 170 connected with the power input shaft 115 is relatively stable, and the part of the reduction gearbox 170 far away from the power input shaft 115 is in a suspended state, by arranging the connection position of the fixing component 180 and the reduction gearbox 170 on the side of the input gear shaft 175 away from the power input shaft 115, the stability of the connection between the reduction gearbox and the plunger pump can be greatly improved, so that the vibration of the plunger pump and the reduction gearbox is effectively reduced.

In some examples, as illustrated by FIG. 3, the fixing component 180 includes a first pull rod 181 and a second pull rod 182; a first end 181A of the first pull rod 181 is fixedly connected with the plunger pump 110, and a second end 181B of the first pull rod 181 is fixedly connected with the reduction gearbox 170; one end of the second pull rod 182 is fixedly connected with the first end 181A or the second end 181B of the first pull rod 181, the other end of the second pull rod 182 is fixedly connected with the plunger pump 110 or the reduction gearbox 170. In this way, the first pull rod 181 and the second pull rod 182 can form a triangular support structure, so that the stability of the connection between the reduction gearbox and the plunger pump can be further improved, and the vibration of the plunger pump and the reduction gearbox is effectively reduced.

For example, as illustrated by FIG. 3, the first end 181A of the first pull rod 181 is fixedly connected with the plunger pump 110, the second end 181B of the first pull rod 181 is fixedly connected with the reduction box 170; one end of the second pull rod 182 is fixedly connected with the second end 181B of the first pull rod 181, and the other end of the second pull rod 182 is fixedly connected with the plunger pump 110. Of course, the embodiments of the present disclosure include but are not limited to the connection manner shown in FIG. 3, one end of the second pull rod can also be fixedly connected with the first end of the first pull rod, in this case, the other end of the second pull rod is connected with the reduction gearbox.

In some examples, as illustrated by FIG. 3, an angle between an extension direction of the first pull rod 181 and an extension direction of the second pull rod 182 is greater than 0 degrees and less than 90 degrees.

Figure 4:
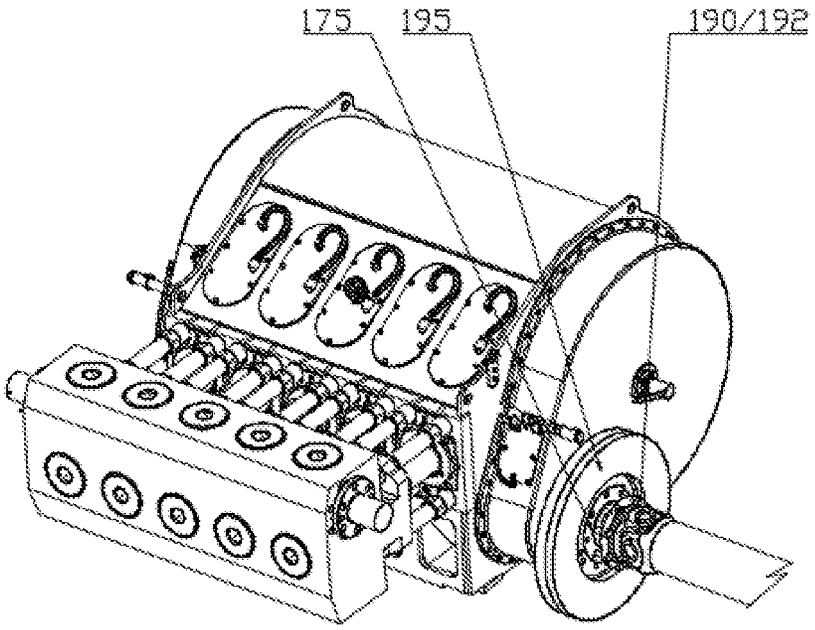
FIG. 4 is a partial schematic diagram of another fracturing apparatus provided by an embodiment of the present disclosure.

FIG. 4 is a partial schematic diagram of another fracturing apparatus provided by an embodiment of the present disclosure. As illustrated by FIG. 1 and FIG. 4, the fracturing unit 100 also includes a flexible coupling 190 or a flexible drive shaft 192, one end of the flexible coupling 190 or one end of the flexible drive shaft 192 is connected with the input gear shaft 175, and the other end of the flexible coupling 192 or the other end of the flexible drive shaft 192 is connected with the power take-off shaft 165. In this way, by arranging the above-mentioned flexible coupling or the flexible drive shaft, slight displacement or angular deviation between the plunger pump and the prime mover can be allowed, to ensure a smoothness of an input power of the plunger pump, so that the vibration can be reduced.

In some examples, as illustrated by FIG. 4, the fracturing unit 100 further includes a silicone oil damper 195, the silicone oil damper 195 may be sleeved on at least one of the input gear shaft 175 and the power take-off shaft 165. In this way, the silicone oil damper can balance a moment of inertia of the input gear shaft or the power take-off shaft, so that the vibration of the plunger pump can be reduced.

In some examples, as illustrated by FIG. 4, the silicone oil damper 195 is sleeved on the gear input shaft 175.

Figure 5:
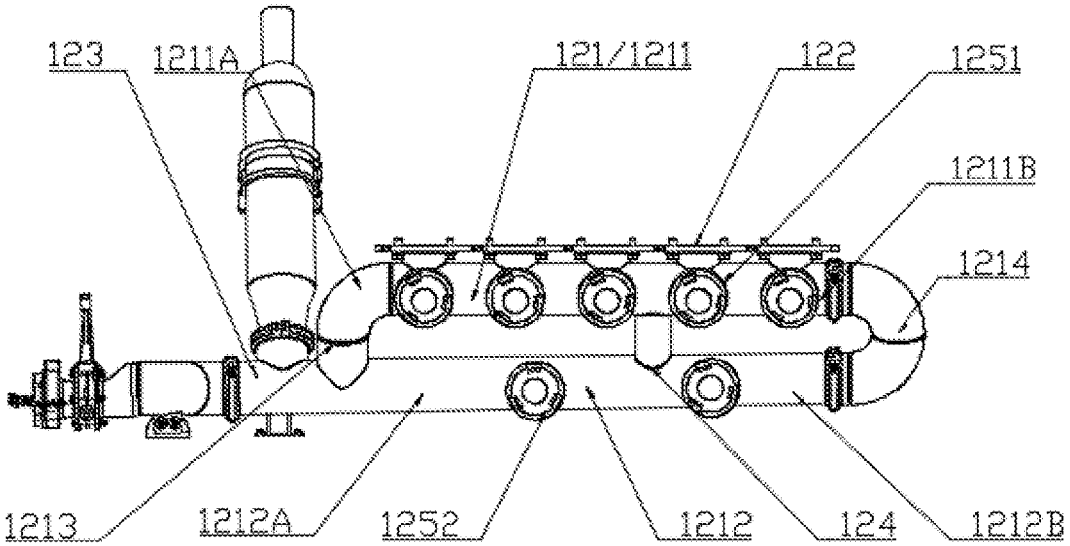
FIG. 5 is a schematic diagram of a low-pressure liquid inlet manifold in a fracturing apparatus provided by an embodiment of the present disclosure.

FIG. 5 is a schematic diagram of a low-pressure liquid inlet manifold in a fracturing apparatus provided by an embodiment of the present disclosure. As illustrated by FIG. 5, the low-pressure liquid inlet manifold 120 includes an annular liquid inlet manifold 121, a liquid inlet connector 122, a liquid supply pipe 123 and an intermediate connection pipe 124; the annular liquid inlet manifold 121 includes an upper liquid inlet pipe 1211, a lower liquid inlet pipe 1212, a first connection pipe 1213 and a second connection pipe 1214; the upper liquid inlet pipe 1211 and the lower liquid inlet pipe 1212 are arranged opposite to each other, the first connection pipe 1213 is respectively connected with a first end 1211A of the upper liquid inlet pipe 1211 and a first end 1212A of the lower liquid inlet pipe 1212, the second connection pipe 1214 is respectively connected with a second end 1211B of the upper liquid inlet pipe 1211 and a second end 1212B of the lower liquid inlet pipe 1212; the liquid inlet connector 122 is located on the upper liquid inlet pipe 121, and is configured to be connected with the plunger pump 110, to provide low-pressure fluid, for example, fracturing fluid, to the plunger pump 110; the liquid supply pipe 123 is communicated with the first end 1212A of the lower liquid inlet pipe 1212; one end of the intermediate connection pipe 124 is communicated with a middle portion of the upper liquid inlet pipe 1211, and the other end of the intermediate connection pipe 124 is communicated with a middle portion of the lower liquid inlet pipe 1212. In this way, after the low-pressure fluid flows from the liquid supply pipe to the annular liquid inlet manifold, a vortex can be formed in the annular liquid inlet manifold, on the one hand, it can reduce solid deposition and ensure sufficient liquid at each liquid inlet connector, on the other hand, the fluctuation generated by the fluid can be reduced, so that the vibration can be reduced.

In some examples, as illustrated by FIG. 5, a first distance D1 between the first end 1211A of the upper liquid inlet pipe 1211 and the first end 1212A of the lower liquid inlet pipe 1212 is greater than a second distance D2 between the second end 1211B of the upper liquid inlet pipe 1211 and the second end 1212B of the lower liquid inlet pipe 122. That is, an axis of the lower inlet pipe is inclined to an axis of the upper inlet pipe, solid deposition caused by horizontal transportation can be reduced, so that the deposition of solids can be further reduced.

For example, an angle between the axis of the lower liquid inlet pipe and the axis of the upper liquid inlet pipe ranges from 0 to 45 degrees.

In some examples, as illustrated by FIG. 5, the low-pressure liquid inlet manifold 120 includes a drain port 1251 and an check port 1252; the drain port 1251 is located on the upper liquid inlet pipe 1211; and the check port 1252 is located on the lower liquid inlet pipe 1212.

Figure 6:
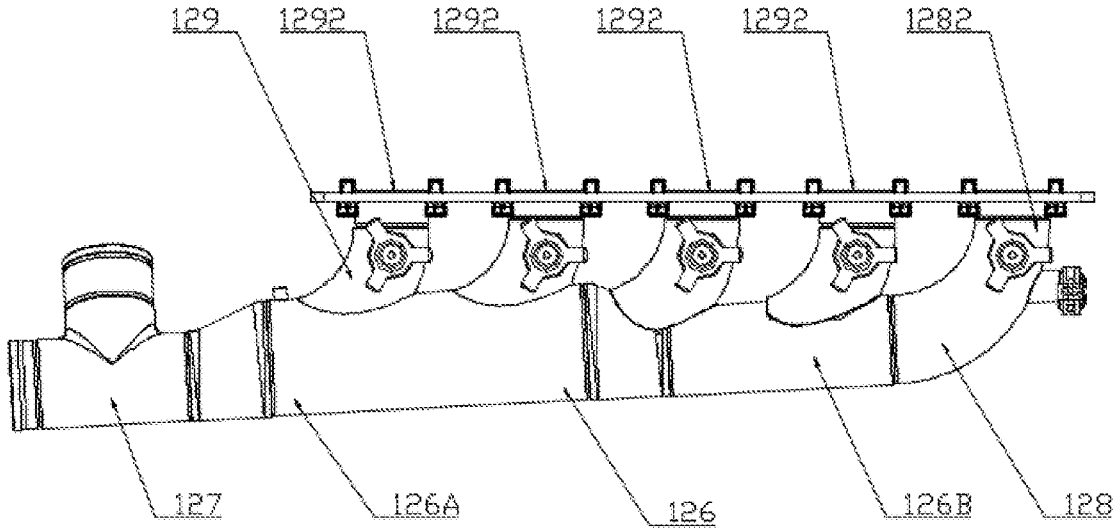
FIG. 6 is a schematic diagram of a low-pressure liquid inlet manifold in another fracturing apparatus provided by an embodiment of the present disclosure.

FIG. 6 is a schematic diagram of a low-pressure liquid inlet manifold in another fracturing apparatus provided by an embodiment of the present disclosure. As illustrated by FIG. 6, the low-pressure liquid inlet manifold 120 includes a main liquid inlet pipe 126, a liquid supply pipe 127, a curved liquid feeding pipe 128, and at least one liquid feeding pipe 129; the liquid supply pipe 127 is communicated with a first end 126A of the main liquid inlet pipe 126; an end of the curved liquid feeding pipe 128 is connected with a second end 126B of the main liquid inlet pipe 126, the other end of the curved liquid feeding pipe 128 is provided with a liquid inlet connector 1282, the liquid inlet connector 1282 is configured to be connected with the plunger pump 110; one end of each of the liquid feeding pipes 129 is connected with the main liquid inlet pipe 126, the other end of each of the liquid feeding pipes 129 is provided with a liquid inlet connector 1292, and the liquid inlet connector 1292 is configured to be connected with the plunger pump 110.

In some examples, as illustrated by FIG. 6, a diameter of the first end 126A of the main liquid inlet pipe 126 is larger than a diameter of the second end 126B of the main liquid inlet pipe 126, in a direction from the first end 126A of the main liquid inlet pipe 126 to the second end 126B of the main liquid inlet pipe 126, at least one of the liquid feeding pipe 129 and the curved liquid feeding pipe 128 are arranged in sequence, and the lengths of the at least one liquid feeding pipe 129 and the curved liquid feeding pipe 128 gradually decrease. As the fluid enters the plunger pump from the liquid feeding pipe, flow rate of the main liquid inlet pipe gradually decreases, the main liquid inlet pipe in the low-pressure liquid inlet manifold provided in the example is a variable diameter pipe, so that it can ensure that flow rate of the connection position of each of the liquid upper pipes and the main liquid inlet pipe and the connection position of the curved liquid feeding pipe and the main liquid inlet pipe is stable, the generation of cavitation is reduced, and the generation of vibration can be suppressed.

On the other hand, since in the direction from the first end of the main liquid inlet pipe to the second end of the main liquid inlet pipe, the lengths of the at least one liquid feeding pipe and the curved liquid feeding pipe gradually decrease, in this way, the main liquid inlet pipe has an upwardly inclined angle with respect to the horizontal direction, so that the settlement caused by horizontal transportation can be reduced.

For example, the included angle between the axis of the main liquid inlet pipe and the horizontal direction is from 0 degrees to 45 degrees.

Figure 7:
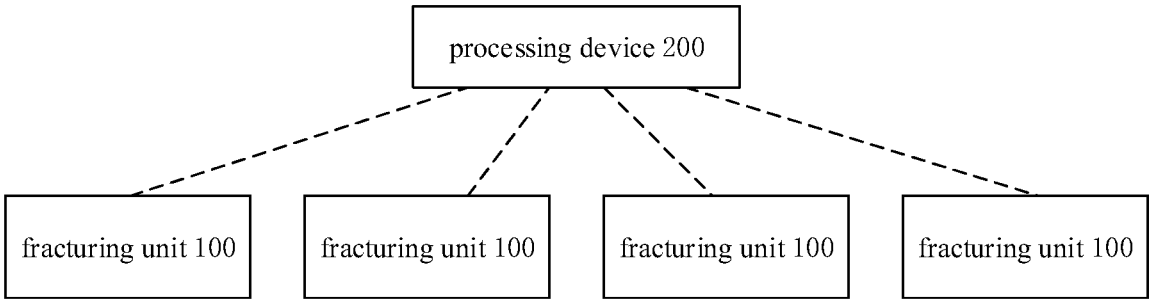
FIG. 7 is a schematic diagram of another fracturing apparatus provided by an embodiment of the present disclosure.

FIG. 7 is a schematic diagram of another fracturing apparatus provided by an embodiment of the present disclosure. As illustrated by FIG. 7, at least one fracturing unit 100 includes a plurality of fracturing units 100, the processing device 200 is respectively communicated with the plurality of plunger pumps 110, the plurality of pressure detection devices 140, and the plurality of vibration detection devices 150 in the plurality of the fracturing units 100. In this way, the processing device can control a plurality of fracturing units as a whole, in the case where the number of strokes of the plunger pump with greater vibration among the plurality of the plunger pumps is reduced, the number of strokes of other plunger pumps can be increased to ensure stability of output displacement of the entire fracturing apparatus.

Figure 8:
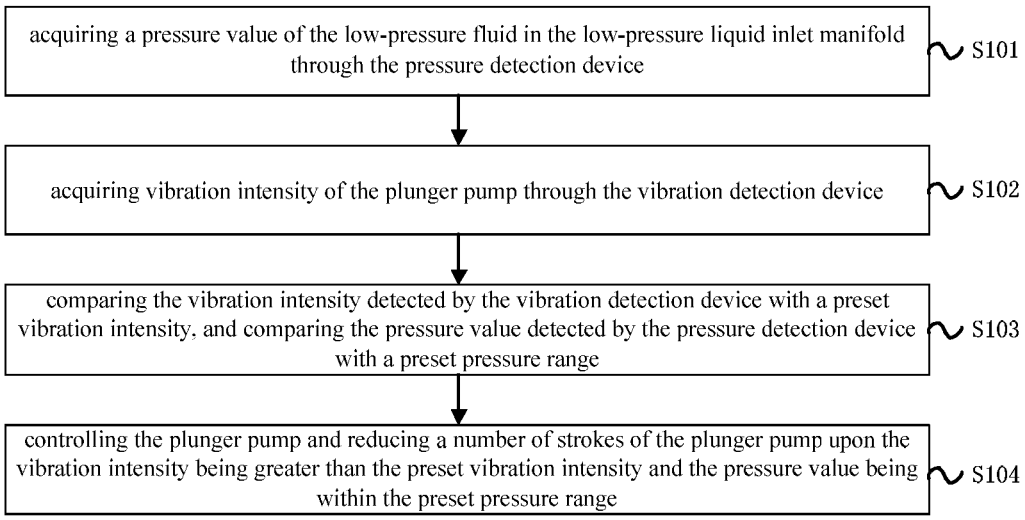
FIG. 8 is a schematic diagram of a vibration reduction method of a fracturing apparatus provided by an embodiment of the present disclosure.

FIG. 8 is a schematic diagram of a vibration reduction method of a fracturing apparatus provided by an embodiment of the present disclosure. As illustrated by FIG. 8, the vibration reduction method includes the following steps S101 to S103.

Step S101: acquiring a pressure value of the low-pressure fluid in the low-pressure liquid inlet manifold through the pressure detection device.

Step S102: acquiring vibration intensity of the plunger pump through the vibration detection device.

Step S103: comparing the vibration intensity detected by the vibration detection device with a preset vibration intensity, and comparing the pressure value detected by the pressure detection device with a preset pressure range.

Step S104: controlling the plunger pump and reducing a number of strokes of the plunger pump upon the vibration intensity being greater than the preset vibration intensity and the pressure value being within the preset pressure range.

In the vibration reduction method of the fracturing apparatus provided by the embodiment of the present disclosure, controlling the plunger pump and reducing the number of strokes of the plunger pump upon the vibration intensity being greater than the preset vibration intensity and the pressure value being within the preset pressure range, the vibration reduction method can effectively reduce the vibration of the plunger pump, and the service life of the plunger pump can be increased. At the same time, because the vibration reduction method does not need to shut down the plunger pump for maintenance upon the vibration intensity being greater than the preset vibration intensity and the pressure value being within the preset pressure range, so that a stable fracturing operation can be ensured, and the efficiency of the fracturing operation can be improved and costs can be reduced.

In some examples, at least one fracturing unit of the fracturing apparatus includes a plurality of fracturing units, the processing device is respectively communicated with the plurality of the plunger pumps, the plurality of the pressure detection devices, and the plurality of the vibration detection devices in the plurality of the fracturing units, the vibration reduction method further includes: acquiring vibration intensity of the plunger pump of each of the fracturing units among the plurality of the fracturing units and a pressure value of the low-pressure fluid in the low-pressure liquid inlet manifold of each of the fracturing units; comparing the vibration intensity of the plunger pump of each of the fracturing units with the preset vibration intensity, comparing the pressure value of the low-pressure fluid in the low-pressure liquid inlet manifold of each of the fracturing units with the preset pressure range; and reducing the number of strokes of the plunger pump of the fracturing unit whose vibration intensity is greater than the preset vibration intensity and pressure value is within the preset pressure range in the plurality of the fracturing units, and increasing the number of strokes of the plunger pumps of other fracturing units among the plurality of the fracturing units.

In the vibration reduction method provided by the example, by reducing the number of strokes of the plunger pump of the fracturing unit whose vibration intensity is greater than the preset vibration intensity and pressure value is within the preset pressure range in the plurality of the fracturing units, and increasing the number of strokes of the plunger pumps of other fracturing units among the plurality of the fracturing units, the vibration reduction method can not only effectively reduce the abnormal vibration of the plunger pump, but also improve the service life of the plunger pump, the stability of the output displacement of the entire fracturing apparatus can be ensured by increasing the number of strokes of other plunger pumps. In this way, the vibration reduction method can perform overall control of the plurality of the fracturing units in the fracturing apparatus, and the vibration reduction method can not only achieve vibration reduction and increase the service life of the plunger pump, but also ensure the stability of the output displacement of the fracturing apparatus.

In some examples, the vibration reduction method further includes: upon the vibration intensity being greater than the preset vibration intensity, and the pressure value being less than the preset pressure range, increasing the pressure of the low-pressure fluid in the low-pressure liquid inlet manifold; and upon the vibration intensity being greater than the preset vibration intensity and the pressure value being greater than the preset pressure range, reducing the pressure of the low-pressure fluid in the low-pressure liquid inlet manifold. In this way, upon the vibration intensity being greater than the preset vibration intensity and the pressure value being not within the preset pressure range, the vibration can be damped by adjusting the pressure of the low-pressure fluid in the low-pressure liquid inlet manifold.

The following points required to be explained:

(1) the drawings of the embodiments of the present disclosure only relate to the structures related to the embodiments of the present disclosure, and other structures can refer to the general design.

(2) without conflict, the embodiments of the present disclosure and the features in the embodiments may be combined with each other to obtain new embodiments.

What are described above is related to only the illustrative embodiments of the present disclosure and not limitative to the protection scope of the present application. Therefore, the protection scope of the present application shall be defined by the accompanying claims

What is claimed is:

1. A fracturing apparatus, including at least one fracturing unit and a processing device, wherein the fracturing unit includes:

a plunger pump;

a liquid inlet manifold, connected with the plunger pump and configured to provide fluid to the plunger pump;

a discharge manifold, connected with the plunger pump, and the plunger pump being configured to pressurize the fluid and discharge it through the discharge manifold;

a pressure detection device, configured to detect a pressure value of the fluid in the liquid inlet manifold; and a vibration detection device, configured to detect vibration intensity of the plunger pump, wherein the processing device is respectively communicated with the plunger pump, the pressure detection device and the vibration detection device, and is configured to control the plunger pump according to the vibration intensity detected by the vibration detection device and the pressure value detected by the pressure detection device.

2. The fracturing apparatus according to claim 1, wherein the processing device is configured to compare the vibration intensity detected by the vibration detection device with a preset vibration intensity, compare the pressure value detected by the pressure detection device with a preset pressure range, and control the plunger pump to reduce a number of strokes of the plunger pump upon the vibration intensity being greater than the preset vibration intensity and the pressure value being within the preset pressure range.

3. The fracturing apparatus according to claim 1, wherein the plunger pump includes a base, a power end and a hydraulic end, the power end and the hydraulic end are arranged on the base, and the power end is connected with the hydraulic end; and the vibration detection device includes a first vibration sensor, a second vibration sensor, and a third vibration sensor, the first vibration sensor is located on the base and is configured to detect vibration intensity of the base, the second vibration sensor is located on the power end and is configured to detect vibration intensity of the power end, and the third vibration sensor is located on the hydraulic end and is configured to detect vibration intensity of the hydraulic end.

4. The fracturing apparatus according to claim 1, wherein the fracturing unit further includes:

a prime mover, including a power take-off shaft;

a reduction gearbox, including an input gear shaft; and a fixing component, wherein the plunger pump includes a power input shaft, the power input shaft is connected with the reduction gearbox, the input gear shaft is connected with the power take-off shaft, one end of the fixing component is fixedly connected with the plunger pump, and an other end of the fixing component is fixedly connected with the reduction gearbox.

5. The fracturing apparatus according to claim 4, wherein a connection position of the fixing component and the reduction gearbox is located on a side of the input gear shaft away from the power input shaft.

6. The fracturing apparatus according to claim 4, wherein the fixing component includes:

a first pull rod, wherein a first end of the first pull rod is fixedly connected with the plunger pump, and a second end of the first pull rod is fixedly connected with the reduction gearbox; and a second pull rod, wherein one end of the second pull rod is fixedly connected with the first end or the second end of the first pull rod, the other end of the second pull rod is fixedly connected with the plunger pump or the reduction gearbox.

7. The fracturing apparatus according to claim 4, wherein the fracturing unit further includes:

a flexible coupling or a flexible drive shaft, one end of the flexible coupling or one end of the flexible drive shaft is connected with the input gear shaft, and the other end of the flexible coupling or the other end of the flexible drive shaft is connected with the power take-off shaft.

8. The fracturing apparatus according to claim 4, wherein the fracturing unit further includes:

a silicone oil damper, sleeved on at least one of the input gear shaft and the power take-off shaft.

9. The fracturing apparatus according to claim 1, wherein the fracturing unit further includes:

an equipment carrier; and an elastic vibration damping device, wherein the plunger pump is fixed on the equipment carrier, one end of the elastic vibration damping device is connected with the discharge manifold, and an other end of the elastic vibration damping device is connected with the equipment carrier or the plunger pump.

10. The fracturing apparatus according to claim 9, wherein the elastic vibration damping device includes at least one of a steel wire vibration damper and a rubber vibration damping pad.

11. The fracturing apparatus according to claim 1, wherein the discharge manifold includes:

a first discharge pipe;

a second discharge pipe; and a movable elbow, respectively connected with the first discharge pipe and the second discharge pipe.

12. The fracturing apparatus according to claim 1, wherein the fracturing unit further includes:

a groove joint, located at a fluid inlet of the liquid inlet manifold; and an energy storage vibration damping module, located on the liquid inlet pipe manifold.

13. The fracturing apparatus according to claim 1, wherein the liquid inlet manifold includes:

an annular inlet manifold, including an upper liquid inlet pipe, a lower liquid inlet pipe, a first connection pipe and a second connection pipe, wherein the upper liquid inlet pipe and the lower liquid inlet pipe are arranged opposite to each other, the first connection pipe is respectively connected with a first end of the upper liquid inlet pipe and a first end of the lower liquid inlet pipe, and the second connection pipe is respectively connected with a second end of the upper liquid inlet pipe and a second end of the lower liquid inlet pipe;

a liquid inlet connector, located on the upper liquid inlet pipe and configured to be connected with the plunger pump;

a liquid supply pipe, communicated with the first end of the lower liquid inlet pipe; and an intermediate connection pipe, wherein one end of the intermediate connection pipe is connected with a middle portion of the upper liquid inlet pipe, the other end of the intermediate connection pipe is communicated with a middle portion of the lower liquid inlet pipe.

14. The fracturing apparatus according to claim 13, wherein a first distance between the first end of the upper liquid inlet pipe and the first end of the lower liquid inlet pipe is greater than a second distance between the second end of the upper liquid inlet pipe and the second end of the lower liquid inlet pipe.

15. The fracturing apparatus according to claim 13, wherein the liquid inlet manifold includes:

a drain port, located on the upper liquid inlet pipe; and a check port, located on the lower liquid inlet pipe.

16. The fracturing apparatus according to claim 1, wherein the liquid inlet manifold includes:

a main liquid inlet pipe;

a liquid supply pipe, connected with a first end of the main liquid inlet pipe;

a curved liquid feeding pipe, wherein one end of the curved liquid feeding pipe is connected with a second end of the main liquid inlet pipe, an other end of the curved liquid feeding pipe is provided with a liquid inlet connector, the liquid inlet connector is configured to be connected with the plunger pump; and at least one liquid feeding pipe, one end of each of the at least one liquid feeding pipe is communicated with the main liquid inlet pipe, an other end of each of the at least one liquid feeding pipe is provided with a liquid inlet connector, and the liquid inlet connector is configured to be connected with the plunger pump, wherein a diameter of the first end of the main liquid inlet pipe is larger than a diameter of the second end of the main liquid inlet pipe, in a direction from the first end of the main liquid inlet pipe to the second end of the main liquid inlet pipe, the at least one liquid feeding pipe and the curved liquid feeding pipe are arranged in sequence.

17. The fracturing apparatus according to claim 1, wherein the at least one fracturing unit includes a plurality of the fracturing units, the processing device is respectively communicated with a plurality of the plunger pumps, a plurality of the pressure detection devices, and a plurality of the vibration detection devices in the plurality of the fracturing units.

18. A vibration reduction method of the fracturing apparatus according to claim 1, including:

acquiring a pressure value of the fluid in the liquid inlet manifold through the pressure detection device;

acquiring vibration intensity of the plunger pump through the vibration detection device;

comparing the vibration intensity detected by the vibration detection device with a preset vibration intensity, comparing the pressure value detected by the pressure detection device with a preset pressure range; and controlling the plunger pump and reducing a number of strokes of the plunger pump upon the vibration intensity being greater than the preset vibration intensity and the pressure value being within the preset pressure range.

19. The vibration reduction method of the fracturing apparatus according to claim 18, wherein the at least one fracturing unit of the fracturing apparatus includes a plurality of the fracturing units, the processing device is respectively communicated with a plurality of the plunger pumps, a plurality of the pressure detection devices, and a plurality of the vibration detection devices in the plurality of the fracturing units, and the vibration reduction method further includes:

acquiring vibration intensity of the plunger pump of each of the plurality of the fracturing units and a pressure value of the fluid in the liquid inlet manifold of each of the fracturing units;

comparing the vibration intensity of the plunger pump of each of the plurality of fracturing units with the preset vibration intensity, comparing the pressure value of the fluid in the liquid inlet manifold of each of the plurality of fracturing units with a preset pressure range; and reducing a number of strokes of the plunger pump of a fracturing unit whose vibration intensity is greater than the preset vibration intensity and pressure value is within the preset pressure range among the plurality of the fracturing units, and increasing a number of strokes of the plunger pumps of other fracturing units among the plurality of the fracturing units.

20. The vibration reduction method of the fracturing apparatus according to claim 18, further including:

increasing pressure of the fluid in the liquid inlet manifold upon the vibration intensity being greater than the preset vibration intensity and the pressure value being less than the preset pressure range; and reducing the pressure of the fluid in the liquid inlet manifold upon the vibration intensity being greater than the preset vibration intensity and the pressure value being greater than the preset pressure range.

* * * * *